United States Patent [19]

Berliner

[11] 4,116,438

[45] Sep. 26, 1978

[54] TABLE TENNIS ROBOT

[76] Inventor: Gustave Berliner, 3243 NE. 143rd Ave., Portland, Oreg. 97230

[21] Appl. No.: 777,830

[22] Filed: Mar. 15, 1977

Related U.S. Application Data

[60] Continuation of Ser. No. 579,929, May 22, 1975, abandoned, which is a division of Ser. No. 504,861, Sep. 11, 1974, abandoned.

[51] Int. Cl.[2] ..... A63B 39/00

[52] U.S. Cl. ..... 273/30; 124/51 A; 124/51 R; 124/1

[58] Field of Search ..... 273/30, 29 A, 29 R, 273/26 D; 124/1, 6, 7, 8, 41 R, 51 A, 49, 53, 56, 57, 58, 59, 60, 61, 62, 63, 64–78

[56] References Cited

U.S. PATENT DOCUMENTS

| | | | |
|---|---|---|---|
| 2,087,575 | 7/1937 | Littell et al. | 273/29 A |
| 2,508,461 | 5/1950 | Lemon | 124/56 |
| 2,793,636 | 5/1957 | Cook | 273/30 |
| 3,855,988 | 12/1974 | Sweeton | 124/56 |
| 3,911,888 | 10/1975 | Harvath | 273/30 |
| 3,917,265 | 11/1975 | Schrier et al. | 124/77 |
| 3,989,245 | 11/1976 | Augustine et al. | 124/56 |

*Primary Examiner*—Richard C. Pinkham
*Assistant Examiner*—T. Brown
*Attorney, Agent, or Firm*—Klarquist, Sparkman, Campbell, Leigh, Hall & Whinston

[57] ABSTRACT

Table tennis balls are pushed by a rotated, notched, feed disc from a hopper to a pair of rotated throwing discs which move each ball along either an adjustable, spin producing, bottom guide or an adjustable, spin producing, upper guide. Thrown balls hit back by a player into a retrieving net roll into a vertical tube having a hose connected to the upper end of the hopper which has a fan mounted therein to draw the balls through the hose into the hopper. The tube is mounted on legs, and the hopper and a drive of the discs are mounted on a bar pivotal on a rod mounted adjustably on the tube. A crank drive carried by the bar and connected to the rod oscillates the bar to vary the direction of throw of the discs. Remote controls are manually actuated to vary the rate of oscillation, to vary the rate of rotation of the feed disc, and to vary the speed of the throwing discs. The net is mounted on segmental rod frames mounted on the tube and an upright secured to the tube.

6 Claims, 11 Drawing Figures

FIG. 1
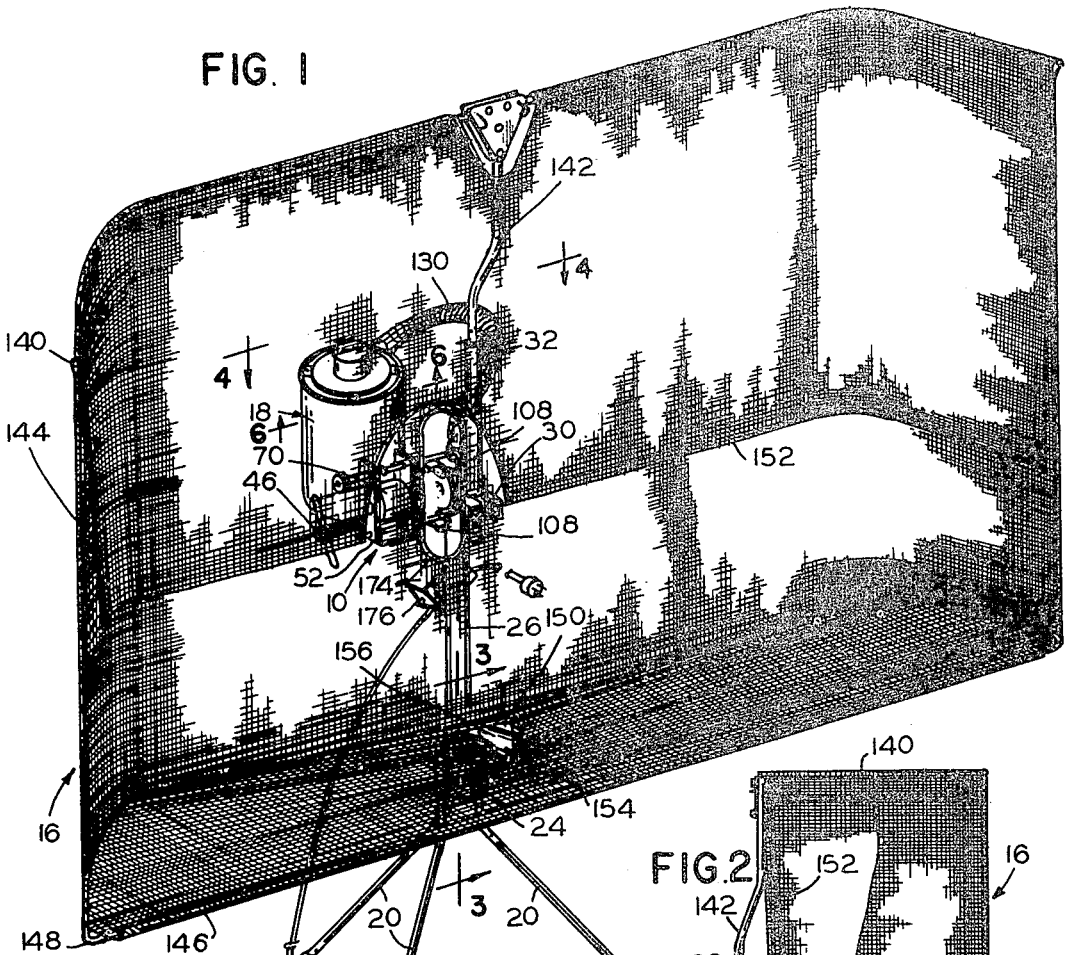
FIG. 2
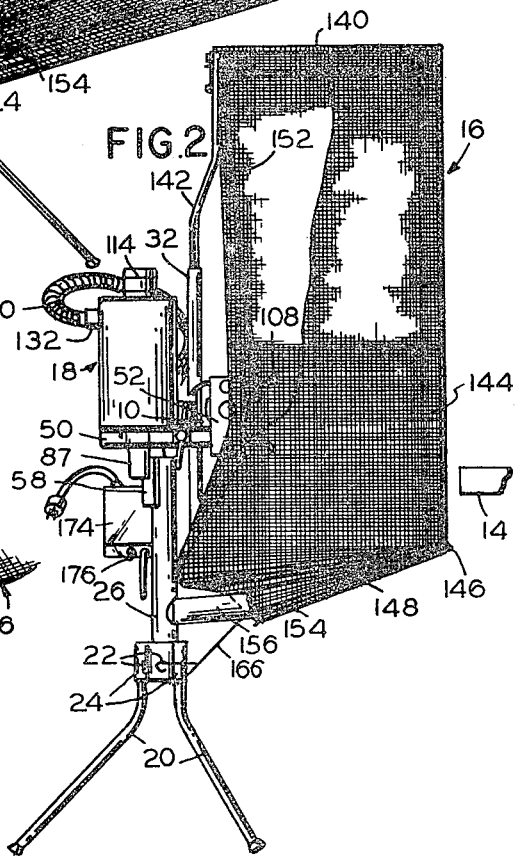
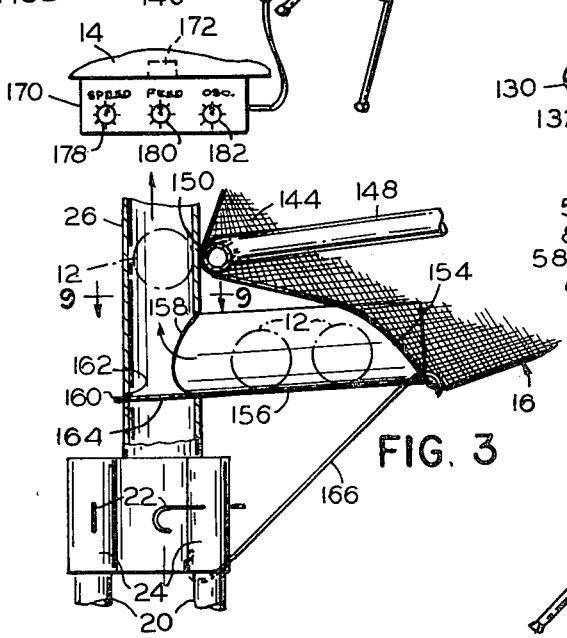
FIG. 3

TABLE TENNIS ROBOT

This is a continuation of applic. Ser. No. 579,929, filed May 22, 1975 abandoned which, in turn, is a division of applic. Ser. No. 504,861, filed Sept. 11, 1974 abandoned.

DESCRIPTION

This invention relates to an improved table tennis robot, and has for an object thereof the provision of an improved table tennis robot.

Another object of the invention is to provide an improved table tennis robot adapted to throw balls and retrieve balls hit back.

Another object of the invention is to provide a table tennis robot adapted to throw balls in automatically varied directions.

A further object of the invention is to provide a table tennis robot manually adjustable to give varied spin velocity, trajectory, and frequency of balls thrown and repeat the throw until the adjustments are changed.

Another object of the invention is to provide a table tennis robot which can be easily assembled and disassembled into a compact condition.

Another object of the invention is to provide a table tennis robot having a remote control adjacent to a player at a player end of a table for adjusting the robot which is at the other end of the table.

In the drawings:

FIG. 1 is a perspective view of an improved table tennis robot forming one embodiment of the invention;

FIG. 2 is a side elevation view of the robot of FIG. 1;

FIG. 3 is an enlarged, fragmentary, vertical sectional view taken along line 3—3 of FIG. 1;

Figure 4:
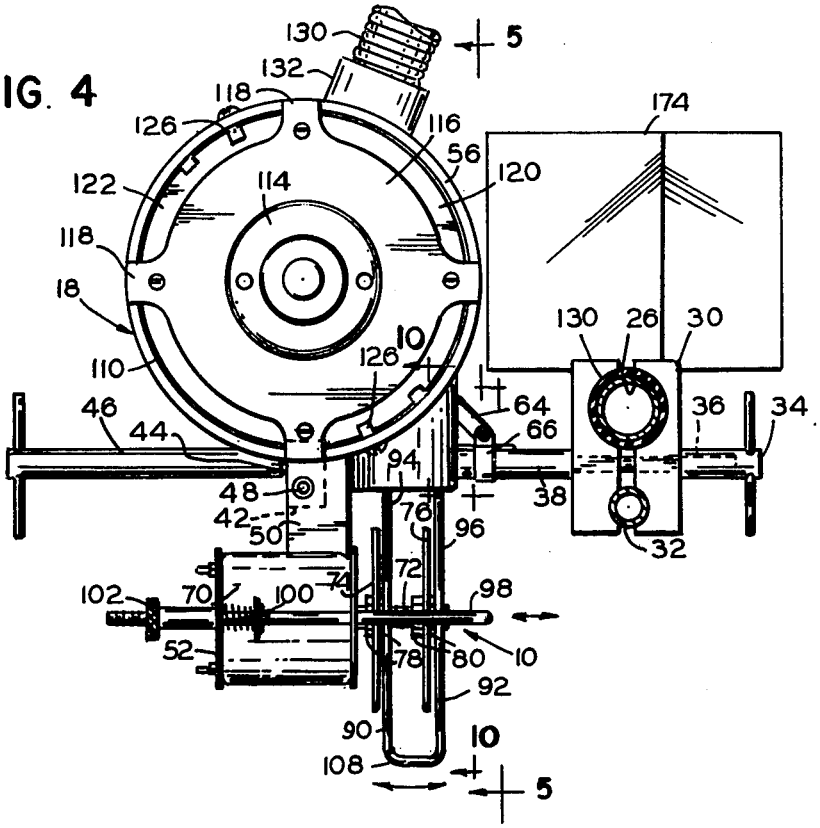
FIG. 4 is an enlarged, fragmentary, horizontal sectional view taken along line 4—4 of FIG. 1.

Referring now in detail to the drawings, there is shown therein an improved table tennis robot forming one embodiment of the invention and which includes a server or thrower 10 (FIG. 1) adapted to throw or serve table tennis balls 12 one after another onto a table tennis table 14 (FIG. 2), a net retriever 16 for collecting balls hit back from the serves by a player, and a hopper device 18 for storing balls collected by the retriever and for feeding the balls to the server 10. The robot includes legs 20 (FIGS. 1—3) detachably secured by pins 22 in sockets 24 fixed to lower end portion of ball return tube 26, which acts as a supporting post for the server, the retriever and the hopper device.

Figure 5:
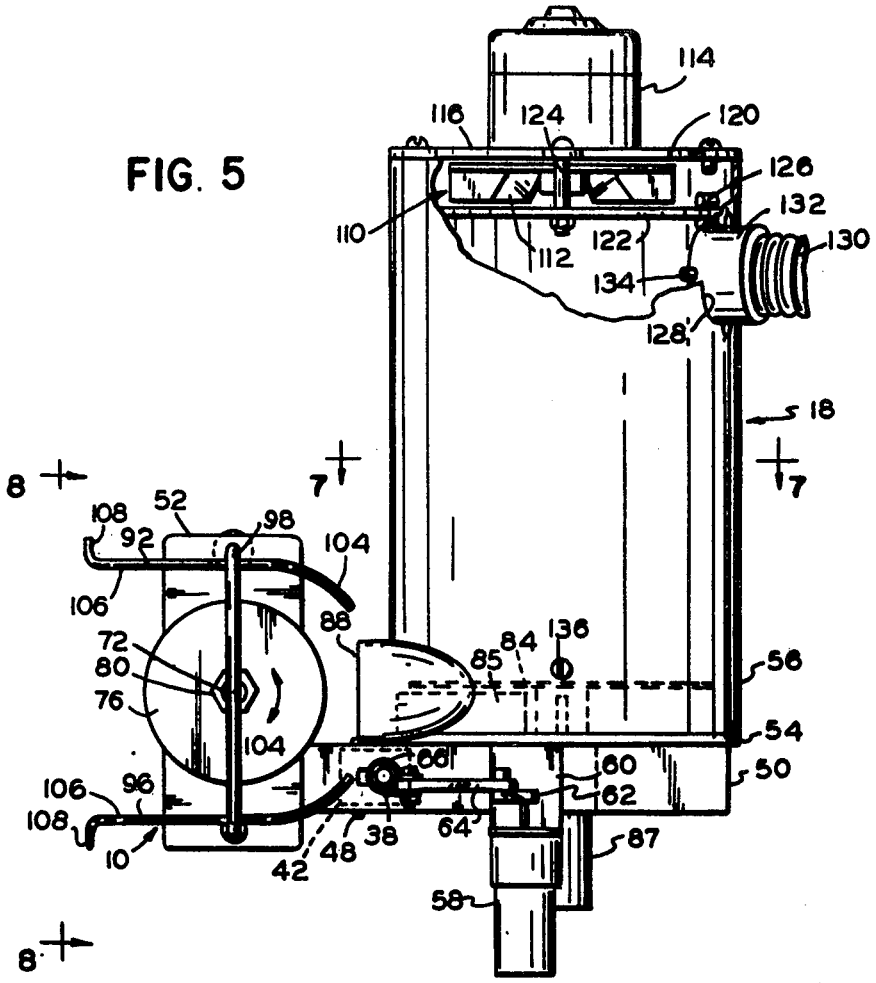
FIG. 5 is an enlarged, fragmentary, vertical sectional view taken along line 5—5 of FIG. 4.
Figure 8:
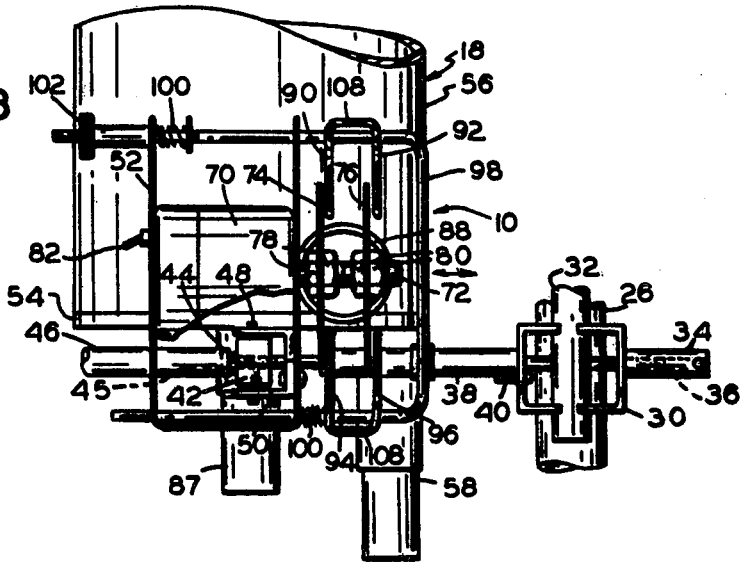
FIG. 8 is an enlarged, fragmentary, front elevation view taken along line 8—8 of FIG. 5.
Figure 9:
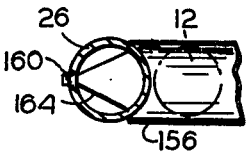
FIG. 9 is an enlarged, fragmentary, horizontal sectional view taken along line 9—9 of FIG. 3.

A split clamp 30 (FIGS. 4 and 8) is clamped onto the tube 26 and a tubular post 32 by a manually operable nut 34 screwed onto a reduced, threaded end portion 36 of a horizontal mounting rod 38 having a key 40 projecting through a keying slot in the clamp 30. The clamp may be adjusted vertically to any desired position on the tube 26. A mounting bar 42 rotatably mounted on a reduced, threaded end portion 45 of the rod is releasably clamped in any desired position of tilt on the rod 38 by a nut 44 screwed onto the threaded end portion 45 of the rod 38 to hold the bar against a shoulder (not shown) on rod 38. The nut is operable by a socket wrench 46. A pin 48 mounts a channel 50 pivotally on the mounting bar for pivotal movement on a generally vertical axis. The server 10 includes a U-shaped frame 52 rigidly secured to the forward end of the channel, and a base 54 of a hopper 56 is rigidly secured to the other end of the channel. A variable speed motor 58 (FIG. 5) is mounted on the channel by a bracket 60 and when energized serves to oscillate the channel on the pin 48 by means of a crank 62 driven by the motor 58 and a link 64 pivotally connected by a clamp 66 to a fixed point of the rod 38.

Figure 7:
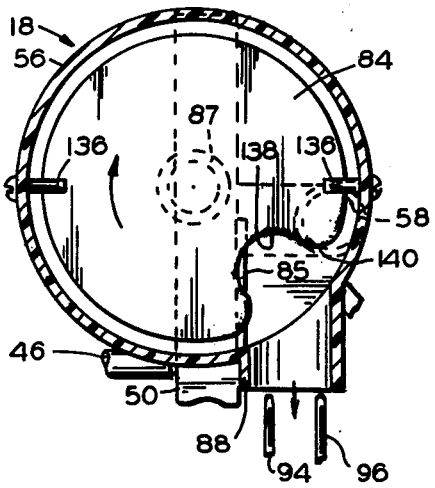
FIG. 7 is an enlarged, fragmentary, horizontal sectional view taken along line 7—7 of FIG. 5.
Figure 10:
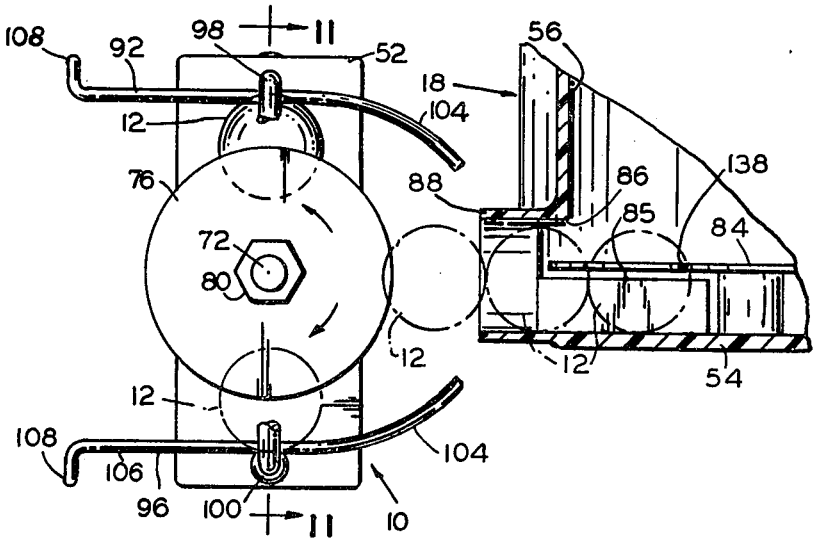
FIG. 10 is an enlarged, fragmentary, vertical sectional view taken along line 10—10 of FIG. 4; and, FIG. 11 is an enlarged, fragmentary, vertical sectional view taken along line 11—11 of FIG. 10.

The server 10 includes a reversible, variable speed motor 70 (FIGS. 4 and 8) carried by the frame 52 and driving a shaft 72. Central portions of a pair of parallel flexible throwing discs 74 and 76 are clamped in adjustably spaced positions by pairs of nuts 78 and 80, respectively, screwed onto the shaft 72. The throwing discs may be rotated in either direction, a switch 82 for reversing the direction of the motor 70 being mounted on the frame 52. The discs are of the same diameter and are centered on the shaft 72. The opposed faces of the discs are roughened or pebbled to provide good gripping. The balls 10 are pushed by a rotated, notched disc 84 (FIGS. 5, 7 and 10) and a deflector 85 out of an exit opening 86 in the hopper 56, through a guide tube 88 and partially between the discs 74 and 76 so that the discs grip them. the guide tube is of a diameter slightly larger than that of the balls so the balls travel freely therethrough. The discs 74 and 76 preferably are positioned equidistantly on opposite sides of the centerline of the guide tube 88. A variable speed motor 87 drives the feed disc 84. The discs 74 and 76 are of a flexible, rough-surfaced material, as, for example, rubber conveyor belting reinforced by cords. In one successful embodiment, the discs were slightly over one-eighth inch thick and were about three and one-half inches in diameter.

Figure 11:
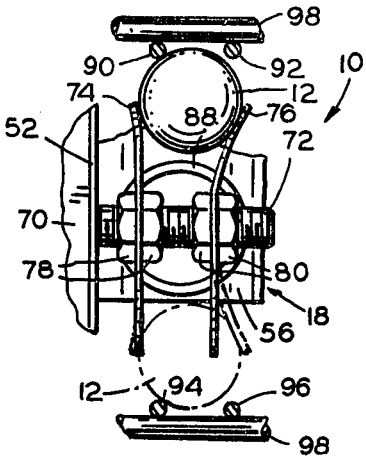

The balls 12 are carried by the discs 74 and 76 depending on the direction of rotation of the discs and positions or rods 90, 92, 94 and 96, along either one or both of parallel upper guide rods 90 and 92 (FIGS. 10 and 11) or along either one or both of parallel, lower guide rods 94 and 96. The pairs of guide rods 90, 92, 94 and 96 are mounted on a U-shaped mounting rod 98 slidable in the frame 52 and urged to the right, as viewed in FIG. 8, by compression springs 100. A knurled nut 102 screwed onto threaded end portion of the rod 98 may be turned manually to move the rod to a position centering the guide rods 90 and 92 and the guide rods 94 and 96 relative to the discs. These positions of the rods 90 and 92 impart underspin to balls moved therealong when the discs are rotated in a counter-clockwise direction, as viewed in FIGS. 5 and 10, and the rods 94 and 96 impart topspin to the balls when the discs are rotated clockwise, as viewed in FIGS. 5 and 10. The rod 98 also may be manually adjusted to the right of center to the position thereof shown in FIG. 11 so only the rod 90 or only the rod 94 engages the balls to impart sidespin to the balls. The discs are rotated sufficiently fast to throw the balls out therefrom, by centrifugal force. However, curved portions 104 of the guide rods 90, 92, 94 and 96 prevent this while the balls are adjacent these curved portions. The curved portions of the guide rods converge toward the peripheries of the discs 74 and 76 and spin the balls. When the ball leaves the curved portions, the discs throw the ball therefrom and along tangential portion or portions 106 of the rod or rods 90, 92, 94 and 96. The tangential portion or portions 106 engage the ball, and impart spin to the ball, sidespin if only one of the rods is engaging the ball or topspin or underspin if two of the guide rods are engaged by the ball. Arcuate clearance bridges 108 join the outer ends of the pairs of guide rods 90, 92, 94 and 96.

Figure 6:
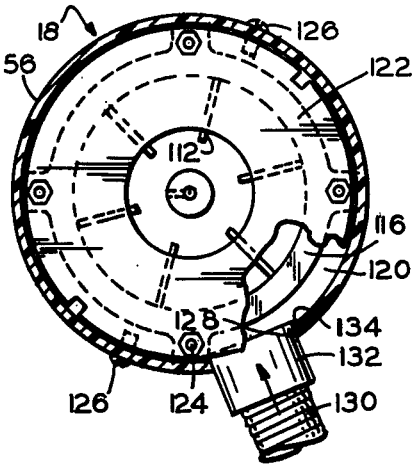
FIG. 6 is an enlarged, fragmentary, horizontal sectional view taken along line 6—6 of FIG. 1.

The hopper device 18 includes at its upper end a centrifugal fan 110 (FIGS. 4 and 5) including an impeller 112 driven by motor 114 mounted on top plate 116 having fingers 118 resting on hopper 56 and forming exhaust openings 120 with the hopper. An annular inlet plate 122 is carried by posts 124 secured to the top plate. Lugs 126 hold the plate 122 against upward movement out of the hopper 56. The hopper has an inlet opening 128 (FIGS. 5 and 6) near its upper end to which a flexible ball return hose 130 is releasably connected by a connector 132 carrying pins 134. The hose 130 is connected at its other end to the upper end of the return tube 26 (FIG. 4), and suction in the hopper created by the fan 110 draws the balls 10 upwardly through the tube 26 and through the hose 130 into the hopper 56 into which the balls drop. Agitator pins 136 (FIGS. 5 and 7) in the hopper above the notched disc 84 help to cause the balls to drop one-at-a time into notch 138 in the disc 84. The notch is of a depth and width each slightly greater than the diameter of each of the balls 12, and corner 140 at the mouth of the notch is rounded to smoothly cam the ball out of the notch when the ball abuts the deflector 85. The disc 84 keeps the ball, which it has just ejected from the hopper into the tube 88, out of the hopper, and when the disc 84 ejects another ball, that ball pushes the previously ejected ball in the tube 88 out further into gripped engagement by the discs 74 and 76.

The retriever 16 (FIGS. 1–3) includes an upper U-shaped rod 140 comprising detachable, interconnecting rod segments supported by gooseneck post 142 supported by tubular post 32. The rod 140 extends through an upper loop in net 144, and front rod 146 composed of detachably interconnected rod segments extends through a lower end loop in the net. The ends of the rod 146 are connected to the ends of lower U-shaped rod 148, which causes the net to assume an L-shape in vertical cross-section. The rod 148 is also composed of detachable segments and forms an upwardly facing shallow "V" 150 at its center. A front curtain or net 152 hangs down from the top of the net 144 to form a damper above the table 14. The net 144 has a discharge opening 154 at its lowest point through which retrieved balls travel to a trough 156 fitting into the bottom of entrance hole 158 in the tube 26. The trough has a tang 160 fitting into slot 162 in the tube 26, and a portion 164 to prevent balls falling out of the tube when the fan is not operated. A wire hook 166 hooks into the tube 26, the trough 156 and the net 144 to make the portion of the net at the end of the trough the lowest portion of the net so that the balls roll into the trough. The nets 144 and 152 have holes in front of the server to permit the balls to be served.

A remote electrical control 170 (FIG. 1) has a clamp 172 which clamps to the table 14 at the player end thereof, and is connected electrically to a converter power pack 174 which is adapted to convert 110 volt a.c. to 12 volt d.c. The control 170 is, of course, connected to the motors 58, 70 and 87. Reversing switch 82 is provided to drive the motor 70 in either direction as desired. The remote control has a manually operable knob 178 to vary the speed of the motor 70, has a manually operable knob 180 to vary the speed of the rotor 87, and also has a manually operable knob 182 to vary the speed of the motor 58. These knobs, when turned, adjust known resistance circuits (not shown) to the motors to vary the speeds thereof.

OPERATION

The balls 12 (FIGS. 10 and 11) in the hopper 56 are pushed one-at-a-time out of the hopper by the notched disc 84, are gripped by the discs 74 and 76, and are thrown one-at-a-time by the discs 74 and 76 along one or more of the rods 90, 92, 94 and 96, depending on the positions of these rods and the direction of rotation of the discs 74 and 76 to the player end of the table 14 (FIG. 2). The player hits the balls back, and they strike the front curtain net 152 and drop down to the bottom of the net 144. The ball travels from the net 144 to the trough 156 and into the return tube 26 from which the ball is sucked by the fan 110 into the hopper 56. Each ball then drops into the hopper and eventually gravitates into the notched disc 84 to be again served. The direction of rotation of the discs 74 and 76 may be reversed by actuating the switch 82 to obtain underspin or topspin as desired. The rods 90, 92, 94 and 96 (FIG. 4) may be shifted to impart sidespin in either direction or to impart simply underspin or topspin when centered. The speed of the notched disc 84 may be varied by turning the knob 180 (FIG. 1) to vary the frequency of serving the balls over a range of from 0 to 70 balls per minute. The server is oscillated, if desired, by setting the knob 182 in a position giving the desired rate of oscillation, from no oscillation to a high speed oscillation of 70 oscillations per minute. This oscillation and the frequency of serve may be set differently so that the directions of the serves vary in a random pattern or may be so set as to provide a fixed pattern of serve. A very large number of patterns may be provided. The tilt of the server also may be adjusted as desired, and can be set to provide service shots (two bounces) or can be set to provide only playing shots.

A screen or guard (not shown) may be placed around the fan 110. The lugs 126 (FIGS. 4 and 5) form with notches in the plate 122 a bayonet slot construction permitting easy release and removal of the fan 110 from the hopper 56. The motor 114 may have the usual two-wire electrical cord (not shown) connected to the upper end portion thereof for supplying power to the motor. As alternative wiring constructions, only one wire is connected directly to the motor, and one of the lugs 126 may be conductive and connected by one wire to a source of electrical power and either the plate 122 be made of electroconductive metal and connected by a wire to the motor or the plate 122 be of electrical insulating material and one of the posts 124 be electroconductive and connected to the motor 114, the plate 122 being rotated to a position in which the electroconductive port is in contact with the electroconductive lugs 126.

To prevent balls from spinning around the hopper 56 when only a few balls are in the hopper, an elastic cord (not shown) may be stretched over the diameter of the disc 84 about ⅜ inch. above the disc, far enough up that the ball in the notch 85 is not contacted by the cord.

What is claimed is:

1. In a ball-throwing robot, a game table, generally vertical net means for catching balls manually hit back over the game table and including a bottom collection portion at a predetermined height which is no higher than the level of a game table with which the robot is to be used, mechanical throwing means for throwing balls in a direction away from the net means and from a height above said predetermined height, means for oscillating the throwing means, hopper means including means for taking balls from the bottom collection portion, elevating the balls to the throwing means and feeding the balls to the throwing means, the hopper means including a hopper container for holding a large number of balls, a ball conduit leading upwardly from the bottom collection portion of the net means to the hopper container, and means independent of the throwing means for creating a partial vacuum in the hopper container and the ball conduit to draw balls through the ball conduit into the hopper container.

2. The ball-throwing robot of claim 1 wherein the entire throwing means and the bottom of the hopper container are above said predetermined height.

3. The ball-throwing robot of claim 2 including means for oscillating the throwing means to periodically change the direction of throw, the throwing means serving to periodically throw balls.

4. In a ball-throwing robot, a stand, a vertical tube secured at its lower end to the stand, throwing means mounted on the tube, net means mounted on the tube for collecting balls, trough means carried by the tube for receiving balls from the net and guiding the balls into the lower end of the tube, partial vacuum creating means carried by the tube for moving the balls upwardly in the tube from the lower end of the tube, and hopper means carried by the tube holding a large number of balls and for transferring balls from the tube, storing the balls and supplying the balls to the throwing means.

5. In a ball-throwing robot, a stand, a vertical tube secured at its lower end to the stand, throwing means, net means mounted on the tube for collecting balls, trough means carried by the tube for receiving balls from the net and guiding the balls into the lower end of the tube, hopper means for storing a large number of balls, means carried by the tube for moving the balls upwardly in the tube from the lower end of the tube to the hopper means, transfer means carried by the tube for transferring balls from the hopper means to the throwing means, and means for oscillating the throwing means.

6. In a ball-throwing robot, a game table, generally vertical net means for catching balls manually hit back over the game table and including a bottom collection portion at a predetermined height which is no higher than the level of a game table with which the robot is to be used, mechanical throwing means for throwing balls in a direction away from the net means and from a height above said predetermined height, means for oscillating the throwing means, and hopper means including means for taking balls from the bottom collection portion, elevating the balls to the throwing means and feeding the balls to the throwing means, the hopper means including a hopper container for holding a large number of balls, a ball conduit leading upwardly from the bottom collection portion of the net means to the hopper container, and means for creating a partial vacuum in the hopper container and the ball conduit to draw balls through the ball conduit into the hopper container, the entire throwing means and the bottom of the hopper container being above said predetermined height, means for oscillating the hopper container and the throwing means therewith to periodically change the direction of throw, the throwing means serving to periodically throw balls.

* * * * *

UNITED STATES PATENT AND TRADEMARK OFFICE

CERTIFICATE OF CORRECTION

PATENT NO. : 4,116,438

DATED : September 26, 1978

INVENTOR(S) : GUSTAVE BERLINER

It is certified that error appears in the above–identified patent and that said Letters Patent are hereby corrected as shown below:

Col. 2, line 34, after the period, change "the" to --The--

Col. 2, line 47, change "or" (1st occurrence) to --of--

Col. 4, line 8, change "rotor" to --motor--

Signed and Sealed this

*Second* Day of *January 1979*

[SEAL]

*Attest:*

RUTH C. MASON
*Attesting Officer*

DONALD W. BANNER
*Commissioner of Patents and Trademarks*